US008472823B2

(12) United States Patent
Okubo et al.

(10) Patent No.: US 8,472,823 B2
(45) Date of Patent: Jun. 25, 2013

(54) IMAGE FORMING APPARATUS FEATURING A CONTROL DEVICE FOR CONTROLLING A DEVELOPER DISCHARGE OPERATION IN FIRST AND SECOND MODES

(75) Inventors: Kazuhiro Okubo, Meridian, ID (US); Masahiro Yoshida, Tokyo (JP); Kazunori Hashimoto, Numazu (JP); Masahiro Shibata, Numazu (JP); Hisashi Yamauchi, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 499 days.

(21) Appl. No.: 12/696,283

(22) Filed: Jan. 29, 2010

(65) Prior Publication Data

US 2010/0196030 A1 Aug. 5, 2010

(30) Foreign Application Priority Data

Jan. 30, 2009 (JP) ..... 2009-019594

(51) Int. Cl.
*G03G 15/08* (2006.01)
*G03G 15/00* (2006.01)

(52) U.S. Cl.
USPC ..... 399/53; 399/43; 399/257

(58) Field of Classification Search
USPC ..... 399/43, 53, 257
See application file for complete search history.

(56) References Cited

U.S. PATENT DOCUMENTS 6,928,253 B2 8/2005 Ojima et al.
7,006,774 B2 2/2006 Saito et al.
7,050,733 B2 5/2006 Saito et al.
7,058,338 B2 6/2006 Ojima et al.
7,149,437 B2 12/2006 Okubo
7,580,654 B2 8/2009 Okubo

FOREIGN PATENT DOCUMENTS

JP 2003-255771 A 9/2003
JP 2004-125829 A 4/2004
JP 2007-264398 A 10/2007

OTHER PUBLICATIONS

JP2003-255771 Machine translation.*
JP2004-125829 Machine translation.*

* cited by examiner

*Primary Examiner* — David Gray
*Assistant Examiner* — Andrew Do
(74) *Attorney, Agent, or Firm* — Fitzpatrick, Cella, Harper & Scinto

(57) ABSTRACT

An image forming apparatus includes first and second developer carrying members and a control device. The apparatus is operable in a first mode where an image of a single color is formed using the first developer carrying member and is operable in a second mode, wherein an image of a plurality of colors is formed using the first and second developer carrying members. The control device controls a first discharging operation for discharging developer from the first developer carrying member and a second discharging operation for discharging developer from each of the first and second developer carrying members. When the apparatus executes only the first mode, the control device performs more image formations, in a period between completion of the second discharging operation and start of the first discharging operation, compared to a period between completion of the first discharging operation and start of a subsequent first discharging operation.

13 Claims, 7 Drawing Sheets

IMAGE FORMING APPARATUS FEATURING A CONTROL DEVICE FOR CONTROLLING A DEVELOPER DISCHARGE OPERATION IN FIRST AND SECOND MODES

FIELD OF THE INVENTION AND RELATED ART

The present invention relates to an image forming apparatus for forming an image by contact of a developer carrying member with a photosensitive drum.

As one of developing methods for a dry-type one component developing apparatus used in the image forming apparatus, an impression development has been known. In the impression development, a lowering in image quality by an increase in number of image formations is caused to occur. The image quality lowering is principally attributable to toner deterioration and contamination of a developing roller (developer carrying member) with the toner.

In order to prevent the toner deterioration, when a print ratio is low, the toner on the developing roller and the deteriorated toner in the neighborhood of the developing roller is transferred onto a photosensitive drum during non-image formation. This is discharging processing which is called "discharging". There has been known a technique such that the toner in the neighborhood of the developing roller is refreshed by effecting the discharging (processing) (Japanese Laid-Open Patent Application (JP-A) 2004-125829).

On the other hand, in order to prevent the developing roller contamination, periodical removal of the toner from the developing roller is effective irrespective of the print ratio and it is possible to prevent the developing roller contamination by performing a discharging operation every print on, e.g., 100 sheets. It is also possible to perform the periodical discharging operation by counting a developing roller rotation time, an operating time of the image forming apparatus, and the like, in addition to the print number. It is possible to refresh the developing roller more reliably by discharging the toner in at least an amount corresponding to one full circumference of the developing roller every occurrence.

Incidentally, in the image forming apparatus capable of full-color image formation, the image formation is effected by using a plurality of photosensitive drums corresponding to the number of a plurality of toner colors (e.g., four colors of yellow, magenta, cyan and black).

In the case of effecting full-color printing, after each of developing rollers supplies associated color toner to an associated one of photosensitive drums, images of the plurality of colors are transferred onto a transfer material through predetermined steps. On the other hand, in the case of effecting monochromatic printing, after a developing roller for black supplies black toner to an associated photosensitive drum, a black image is transferred onto the transfer material through the predetermined steps.

With respect to the image forming apparatus for effecting the full-color printing, such as a technique that a refreshing operation of the developing roller in a black developing unit and those in color developing units are performed with different timings has been known (JP-A 2003-255771). Further, such a technique that the refreshing operation is performed in all the developing units, in the image forming apparatus for effecting the full-color printing, with timing of execution of the toner refreshing operation in one of the developing units has also been known (JP-A 2007-264398).

In the above-described conventional techniques, however, when the image forming apparatus alternately executes the full-color printing and the monochromatic printing, the following problems are caused to occur.

For example, when the full-color printing is effected with a predetermined amount of usage of the developing units, a discharging operation can be performed from each of the developing units. In this case, when the printing is effected in any alternation of the full-color printing and the monochromatic printing, the amount of usage of the black developing unit and those of the developing units other than the black developing unit (i.e., the color developing units) are different from each other. In this case, timing of black toner discharging is delayed by the amount of usage of the black developing unit in the black printing. In an extreme example, in the case where only the black developing unit is used in the monochromatic printing, the discharging operation from the black developing unit is not performed.

As another example, a method in which a counter for counting the amount of usage of the black toner and a counter for counting the amount of usage of the color toners are separately provided can be employed. In this method, the black developing unit discharging operation is performed when the black developing unit reaches a predetermined amount of usage, and the discharging operation of the (color) developing units other than the black developing unit is performed when the developing unit reaches a predetermined amount of usage. In this case, the discharging operation of the black developing unit and the discharging operation of the (color) developing units are successively performed alternately. For this reason, the number of occurrences of interruption of the printing by performing the discharging operation is two times that in the case of the full-color printing. As a result, a printing speed is lowered.

Further, a method in which discharging operations of all the cartridges are performed collectively with timing of the toner discharging with respect to any of the developing units can be employed. In this case, however, although some of the developing units are little used, the discharging is performed in all the developing units with discharging timing of another developing unit in some instances. Here, when the predetermined amount of toner is discharged from each of all the developing units, the toner is consumed more than necessary. JP-A 2007-264398 discloses a technique in which the discharging amount is changed depending on an integrated value of the number of pixels for each of the developing units for all colors. However, in the case where the integrated value of the number of pixels is small, the amount of the discharged toner is excessively small, so that there is a possibility that the discharging of deteriorated toner cannot be performed sufficiently.

SUMMARY OF THE INVENTION

A principal object of the present invention is to retain an image quality by performing a discharging operation while suppressing a lowering in printing speed by the discharging operation.

This and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

An image forming apparatus according to an embodiment of the present invention includes a mechanism for separating a transfer conveyer belt. During monochromatic printing, the transfer conveyer belt is separated at portions of cartridges other than a black cartridge. In the image forming apparatus of this embodiment, a method of discharging toner from a developing device while keeping the number of occurrences of discharging and a discharge amount at appropriate levels when the image forming apparatus is used by arbitrarily switching a full-color printing mode to a monochromatic printing mode will be described. Incidentally, the monochromatic printing mode (first printing mode) refers to a mode in which single color (monochromatic) image formation is effected by using only a first image bearing member (first photosensitive member) and a first developer carrying member (first developing roller). The full-color printing mode (second printing mode) refers to a mode in which plural-color image formation is effected by using the first image bearing member, the first developer carrying member, a second image bearing member (second photosensitive member), and a second developer carrying member (second developing roller).

(Schematic Structure of Image Forming Apparatus)

Figure 1:
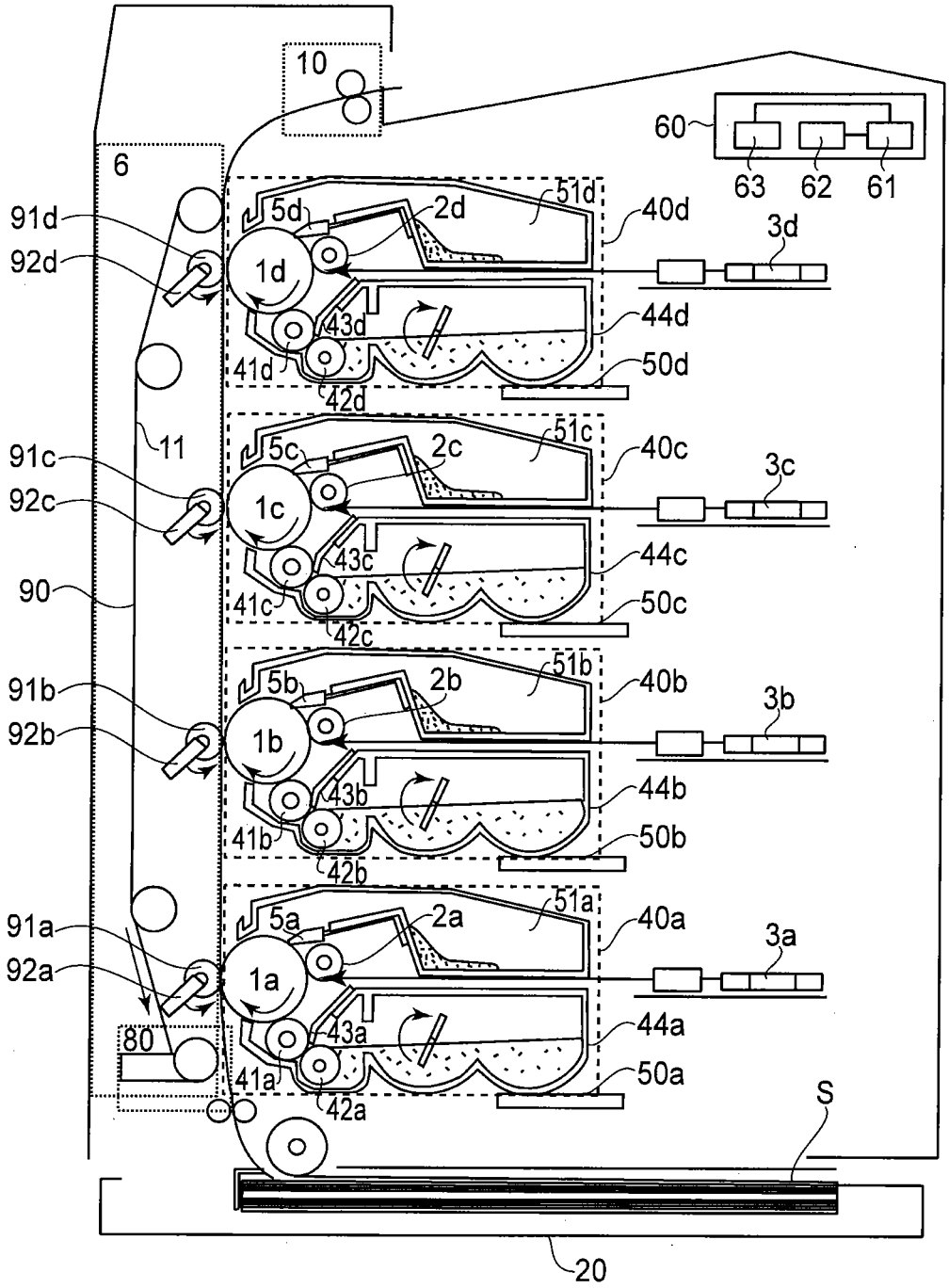
FIG. 1 is a schematic view showing an embodiment of an image forming apparatus.

FIG. 1 is a schematic view of an image forming apparatus. The image forming apparatus according to the present invention includes a plurality of process cartridges 40 (40*a*, 40*b*, 40*c* and 40*d*) which includes a plurality of color toners and are arranged in a tandem manner. Incidentally, in FIG. 1, respective process means are represented by reference numerals with suffixes a, b, c and d.

Each of the process cartridges 40 includes a photosensitive drum 1 (image bearing member) capable of forming an electrostatic latent image by exposure means, a charging roller 2 (charging means) for electrically charging a surface of the photosensitive drum 1 uniformly, and a developing roller 41 (developing means) for developing the electrostatic latent image on the photosensitive drum 1 with toner.

Further, the image forming apparatus includes: a transfer conveyer belt 90 for conveying a transfer material (e.g., recording paper or the like); a transfer roller 91 (transfer means), capable of applying a bias, for urging the transfer conveyer belt against an associated photosensitive drum 1 with a predetermined urging pressure; and a transfer roller separating mechanism 92 (transfer means contact and separation mechanism) for separating the transfer conveyer belt from the associated photosensitive drum 1. The transfer roller 91 is movable toward and away from the photosensitive drum 1 through the belt 90 by the transfer means contact and separation mechanism. The image forming apparatus further includes a developing roller contact and separation mechanism 50 for performing a contact and separation operation for moving the developing roller 41 toward and away from the photosensitive drum 1 in each of the cartridges 40 for respective colors in an independent manner. Incidentally, in place of the transfer conveyer belt, it is also possible to use an intermediary transfer belt for primary-transferring a toner image formed on the photosensitive drum 1.

(Detailed Constitution and Operation of Image Forming Apparatus)

First, an operation of the image forming apparatus at the time of full-color image formation will be described.

The photosensitive drums 1 at all the first to fourth stations are driven. Then, a bias (about −1000 V) is applied to the charging rollers 2 in the order of those of the first process cartridge 40*a* at the first station to the fourth process cartridge 40*d* at the fourth station, so that the surfaces of the photosensitive drums 1 are successively charged (to about −500 V) uniformly. The developing roller 41 is rotationally driven and is supplied with a predetermined developing bias (about −350 V). Then, the developing roller mechanism 50 is actuated to cause the developing roller 41 to contact the photosensitive drum 1 while rotating the developing roller 41.

These preparatory operations are performed, with image formation start timing, successively from the first to fourth stations. Then, from the first to fourth stations in succession, an electrostatic latent image is formed on the photosensitive drum 1 by laser beam scanning with an exposure device 3. The electrostatic latent image is visualized into a toner image (developer image) with a developer on the developing roller 41.

Further, along the respective process cartridges 40, the transfer conveyer belt 90 constituting a transfer material carrying and conveying means 6 for carrying and conveying the transfer material is disposed. The transfer conveyer belt 90 is stretched and rotationally driven by a driving roller as a belt driving means, a follower roller, and a stretching roller. The transfer conveyer belt 90 is urged against the photosensitive drum 1 by the transfer roller 91 disposed inside the belt.

Separately, the transfer material S is picked up from a sheet feeding portion 20 one by one by a pick-up roller and is fed to the transfer conveyer belt 90. The transfer materials S is attracted and carried by the transfer conveyer belt 90 by the action of an attracting roller 90 as an attracting means.

The transfer material S is conveyed to a transfer portion while being timed with the toner image on the photosensitive drum 1*a* at the first station. The toner image is transferred onto the transfer material by applying a bias (about +1500 V) to the transfer roller 91 and then is subjected to an image forming operation again.

Further, also with respect to the second to fourth process cartridges 40*b* to 40*d*, similarly as in the case of the above-described first process cartridge 40*a*, a toner image of an associated color is formed on the photosensitive drum 1. When the transfer material S is successively conveyed to the respective transfer portions at the second to fourth stations, the respective color toner images are superposed and transferred by applying a bias to each of the respective transfer rollers 91.

Then, the transfer material P subjected to transfer of the four color toner images at the most downstream fourth process cartridge 40*d* is conveyed to a fixing portion 10, at which the toner images are melt-fixed and then the transfer material S is discharged.

A developing device 44 includes the developing roller 41 as the developer carrying member, a supplying roller 42 for supplying (negative) toner as the developer to the developing roller 41, and a developing blade 43 as a developer regulating member for regulating an amount of toner on the developing roller 41.

The developing roller 41 contacts the photosensitive drum 1, the developing roller 41 is formed with an elastic member. To the developing roller 41, a predetermined potential is supplied from a developing bias voltage source (not shown) in order to transfer the toner image from the developing roller 41 onto the photosensitive drum 1.

After the image formation is completed, the developing roller cartridge mechanism 50 is actuated to separate the developing roller 41 from the photosensitive drum 1. Then, the charging bias and the transfer bias are turned off and the rotation of the photosensitive drum 1 is stopped, so that all the image forming operations are completed.

Next, a method of effecting the monochromatic printing using a specific developing roller 41 will be described below. The image forming apparatus of this embodiment includes the transfer separating mechanism 92 for separating the transfer roller 91. By releasing urging of the transfer 91 against the photosensitive drum 1, the transfer conveyer belt 90 is separated from the photosensitive drum 1.

At the time of the monochromatic printing, the transfer rollers 91 for the respective colors other than that for the fourth (black) process cartridge 40*d* disposed at the fourth station are separated. Thus, the transfer conveyer belt 90 is separated from the associated photosensitive drums 1 and the monochromatic printing is effected while stopping the drive of the color process cartridges (40*a* to 40*c*) other than the fourth (black) process cartridge 40*d*.

Rotations of the respective photosensitive drums 1, developing rollers 41 and charging rollers 2 for the respective colors, which are brought into non-contact with the transfer conveyer belt 90 are stopped. By stopping the rotations of the photosensitive drums 1, the developing rollers 41 and the charging rollers 2, abrasion (wearing) of the photosensitive drum 1 by a cleaning blade 5 is not caused to occur. Therefore, a lifetime of the process cartridge 40 can be increased.

In the case where the transfer conveyer belt 90 is in a contact state when the image forming apparatus receives a monochromatic printing signal, first, the separating operation for the transfer conveyer belt 90 is performed. Then, the image formation for only black is effected to carry out the above-described image forming steps, thus providing a monochromatic print image.

Embodiment 1

Referring to FIG. 1, a control means 60 takes charge of control of the entire image forming apparatus. The control means 60 at least includes a CPU 61, a calculating means for calculating a monochromatic discharge (calculation) value and a calculating means for calculating a full-color discharge (calculation) value.

(Discharging Operation)

Next, an operation during the discharging will be described. The discharging operation refers to an operation for refreshing the toner in the neighborhood of the developing roller 41 by transferring (discharging) the toner on the developing roller 41 and deteriorated toner in the neighborhood of the developing roller 41 onto the photosensitive drum 1 during non-image formation. More specifically, in this embodiment, the discharging operation refers to a developer discharging operation for discharging the developer in a predetermined amount when the discharge value for the cartridge reaches a predetermined.

In a specific operation of the discharging operation, during the non-image formation, an electrostatic latent image for the refreshing is formed on the electrically charged photosensitive drum surface (e.g., by effecting light exposure with respect to the entire surface scanning direction) and then is developed by the developing device.

The discharging operation may also be performed with timing such as during a stand-by mode free from the print signal, end of continuous printing, or during the continuous printing, in addition to during the non-image formation.

(Examples and Problems of Discharging Operations Other Than Discharging Operation in the Present Invention)

For example, in the case of the effecting the full-color printing (image formation) (all-color mode), the amount of usage of each of the color cartridges from the completion of the previous discharging operation is calculated as the discharging value by the control means. Then, in the case where the discharge value reaches the predetermined threshold, the printing is temporarily interrupted and then the discharging operation is executed for the time corresponding to one full turn of the developing roller. By repeating this operation, the developing roller is refreshed once every predetermined printing with reliability to discharge the deteriorated toner, so that developing roller contamination and image defect due to the toner deterioration can be prevented. A method of calculating the discharge value may also be executed by counting a print number or the number of rotation of the developing roller.

However, in the above-described method, the discharging for the black cartridge is delayed by a time period in which the monochromatic printing mode (single-color mode) is executed, so that there is a possibility of occurrences of the developing roller contamination and the toner deterioration.

In view of this possibility, a method of calculating the full-color discharge value and the monochromatic discharge value separately can be considered.

In this method, when the monochromatic printing is effected to use the black cartridge, the amount of usage of the black cartridge from the completion of the previous discharging operation is calculated as the monochromatic discharge value. Then, in the case where the monochromatic discharge value reaches a predetermined threshold (first threshold) during the monochromatic printing, the printing is temporarily interrupted and then the discharging operation is executed for the time corresponding to one full turn of the developing roller. As a result, even when the monochromatic printing is continued, the discharging operation for the black cartridge can be performed.

Further, during the color printing, both of the full-color discharge value and the monochromatic discharge value are calculated and when the full-color discharge value reaches a predetermined threshold (second threshold), the discharging operation for the cartridges for yellow, magenta and cyan is executed (color discharging operation function). On the other hand, when the monochromatic discharge value reaches the predetermined threshold, the discharging operation for the black cartridge is executed (single color discharging operation function).

However, in the case where the full-color printing is continued in a state in which the full-color discharge value and the monochromatic discharge value are deviated from each other, the printing operation is temporarily interrupted and the discharging operation is executed every time when either one of the discharge values reaches the predetermined threshold. As a result, a waiting time of a user is increased.

In view of this inconvenience, a method in which the amount of usage of the full-color cartridges from completion of the previous full-color discharging operation is calculated as the full-color discharge value during the full-color printing and when the full-color discharge value reaches the predetermined threshold, the black discharging operation and the full-color discharging operation are executed in combination can be considered.

In this method, however, the number of occurrences of the black discharging operation is increased, so that the toner is excessively consumed.

(Discharge Operation in this Embodiment)

In this embodiment, a method in which a degree of non-uniformity of the above-described discharge is reduced and the user waiting time is reduced when the toner discharging operation is performed will be described.

Figure 2:
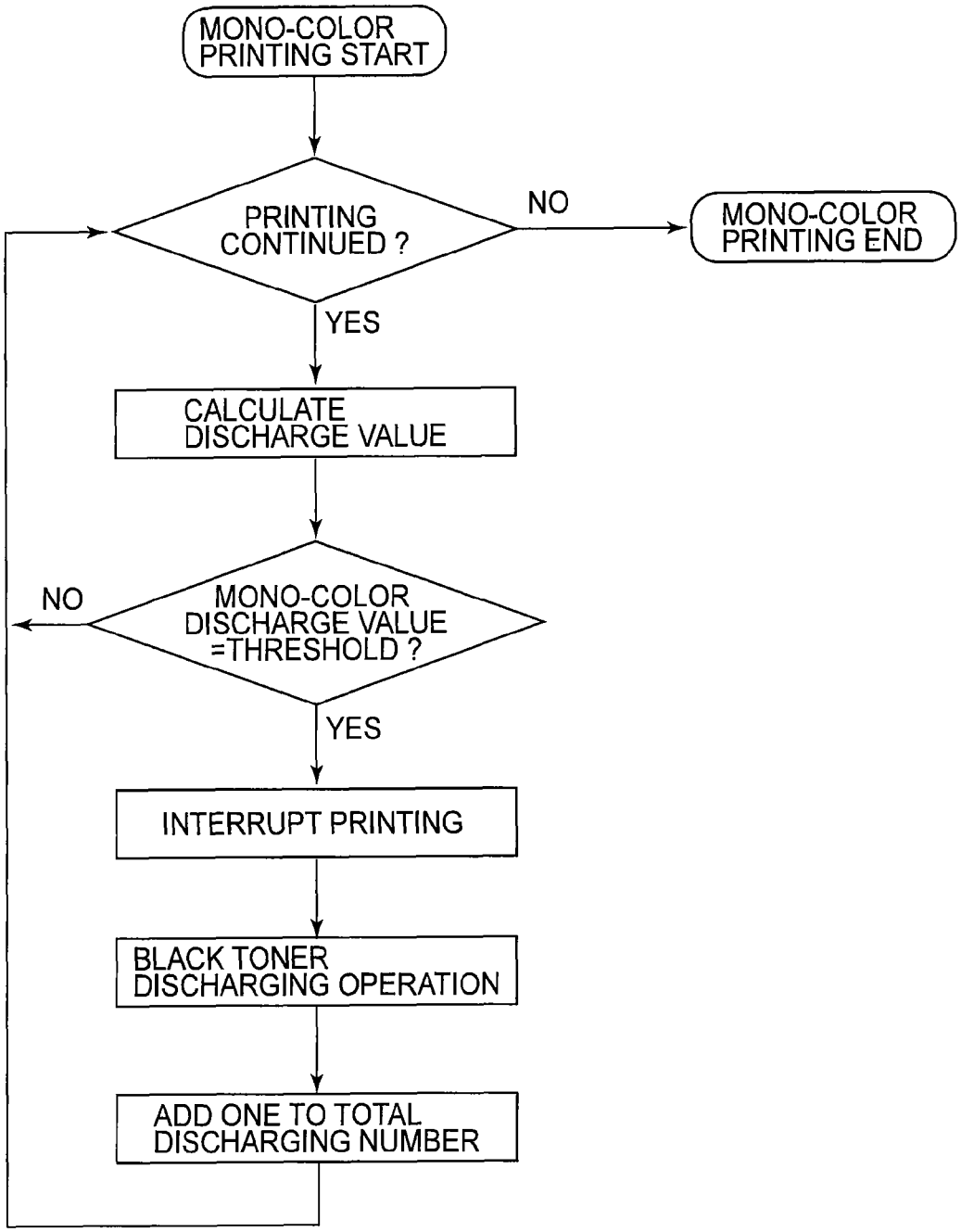
FIG. 2 is a flowchart at the time of monochromatic printing.
Figure 3:
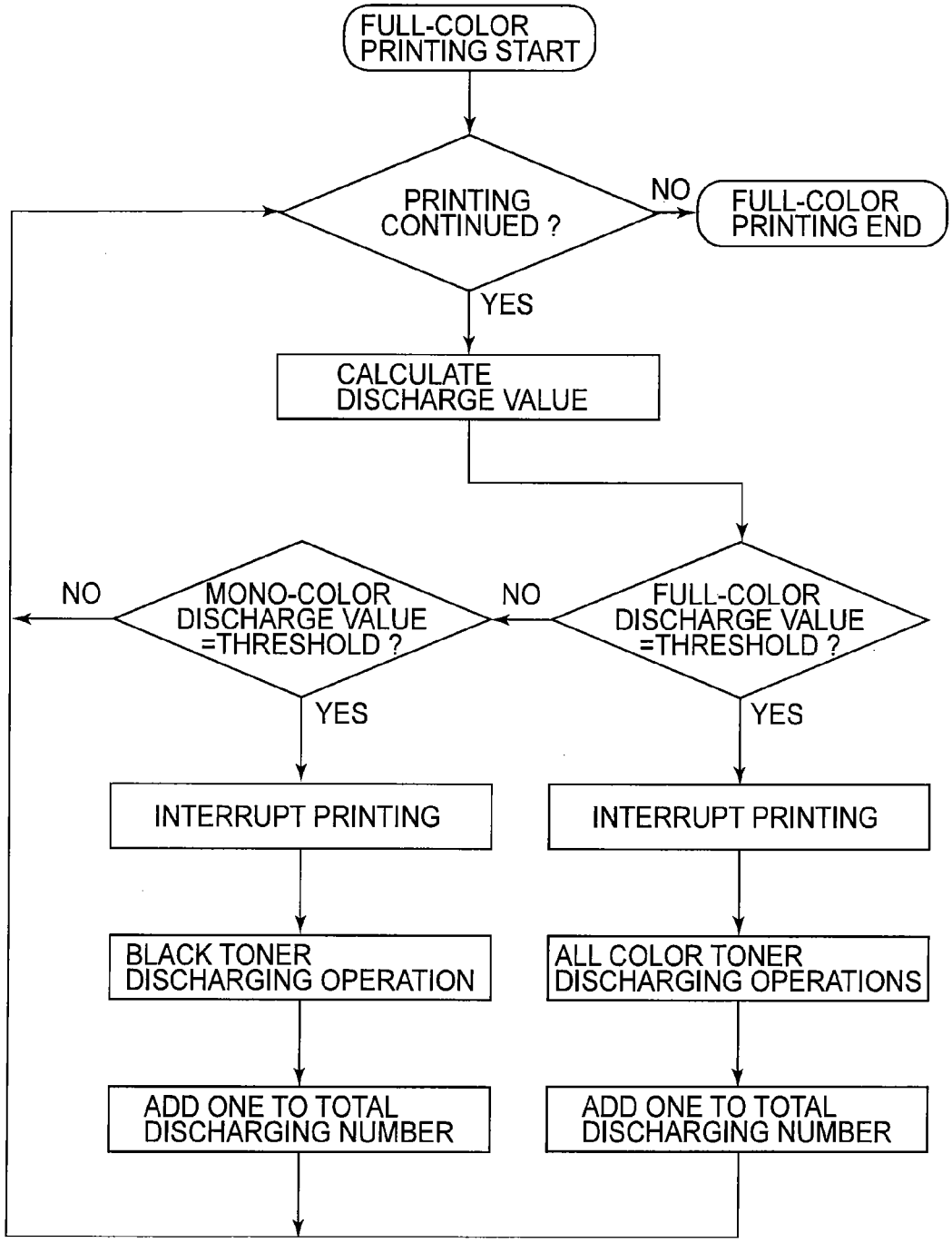
FIG. 3 is a flowchart at the time of full-color printing.

With reference to FIGS. 2 and 3, the discharging operation in this embodiment will be described. FIG. 2 is a flowchart at the time of the monochromatic (mono-color) printing and FIG. 3 is a flowchart at the time of the full-color printing.

In this embodiment, during the full-color printing, the amount of usage of the full-color cartridges from completion of the previous full-color discharging operation is calculated as the full-color discharge value (second value). Further, the amount of usage of the black cartridge from completion of the previous monochromatic discharging operation is calculated as the monochromatic discharge value (first value). During the monochromatic printing, only the monochromatic discharge value is calculated. These full-color and monochromatic discharge values are used as information on the amount of usage of the developing roller. This is because the tone deterioration or the like shows a correlation with the amount of usage of the developing roller.

The discharge value may be calculated on the basis of the print number or a rotation time of the developing roller. In this embodiment, the discharge value is calculated on the basis of the print number and is performed once every 100 sheets. That is, 100 is the discharging threshold.

Further, as a method of calculating the discharge value, it is possible to use a method in which a reference numerical value such as the print number is counted up and recorded and a method in which the discharge value is obtained by calculation using the monochromatic print number, the full-color print number, and the number of occurrences of the discharging operation.

In this embodiment, the method in which a total monochromatic print number, a total full-color print number, and a total number of occurrences of the discharging operation are counted and from resultant values, the full-color discharge value and the monochromatic discharge value are calculated will be described.

The full-color discharge value is the remainder (integer) of division of (total full-color print number) by (discharging threshold). In this embodiment, the discharging is effected one every 100 sheets, i.e., the discharging threshold is 100, so that the last two-digit number of the total full-color print number is the full-color discharge value.

The monochromatic discharge value is obtained by subtracting a value of multiplication of the total number of occurrences of the discharging operation and the discharging threshold from the sum of the total full-color print number and the total monochromatic print number.

Monochromatic (mono-color) discharge value=(total full-color print number+total monochromatic print number)−(total number of occurrences of discharging operation×discharging threshold).

In this case, the monochromatic discharge value is a negative (minus) value in some instances.

As shown in FIG. 2, in the case where the monochromatic discharge value reaches the predetermined during the monochromatic printing, the printing is temporarily interrupted and the black discharging operation is performed. Then, one is added to the total number of occurrences of the discharging operation.

Further, as shown in FIG. 3, in the case where the monochromatic discharge value reaches the predetermined threshold during the full-color printing, the printing is temporarily interrupted and the black discharging operation is performed. Then, one is added to the total number of occurrences of the discharging operation.

In the case where the full-color discharge value reaches the predetermined threshold during the full-color printing, the printing is temporarily interrupted and the discharging operations for all the colors including black are performed. Then, one is added to the total number of occurrences of the discharging operation. By adding one to the total number of occurrences of the discharging operation, as a result of calculation, a numerical value corresponding to the discharge threshold is subtracted from the monochromatic discharge value before the discharging operation.

By performing the above-described operation, the black discharging operation can also be performed with discharging timing for the color cartridges, so that frequent interruption of the printing can be prevented.

Further, the number corresponding to the black cartridge discharging operation moved forward by providing the timing of the color cartridge discharging operation to the black cartridge discharging operation is counted as the total number of occurrences of the discharging operation, so that the monochromatic discharge value is the negative value. As a result, the timing of the next black cartridge discharging operation is delayed, so that an averaged discharging operation can be performed until the end of the lifetime of the cartridges. Thus, the monochromatic discharge value becomes negative, so that an executable number of image formations in the full-color mode until the next monochromatic discharging operation is performed is changed between after the monochromatic discharging operation and after the full-color discharging operation. That is, compared with the case of after the monochromatic discharging operation, in the case of after the full-color discharging operation, the executable number of image formations in the monochromatic mode is increased by the number corresponding to the negative value of the monochromatic discharge value.

As a result, it is possible to prevent the lowering in image quality due to the developing roller contamination and the toner deterioration while suppressing the excessive toner consumption.

Incidentally, in the case of using the above method, an interval between the black cartridge discharging operation and its subsequent black cartridge discharging operation can be two times the predetermined threshold at the maximum.

Further, in this embodiment, the non-uniformity and frequency of the discharging operation are alleviated by subtracting the value corresponding to the predetermined threshold from the monochromatic discharge value but the present invention is not limited thereto. For example, also in the case where the monochromatic discharge value reaches the predetermined threshold during the full-color printing, similarly, the method in which the printing is temporarily interrupted and the discharging operations for all the colors are performed and then the value corresponding to the predetermined threshold is subtracted from the full-color discharge value may be employed.

In this method, in the case where the discharging operations for all the colors are performed when the monochromatic discharge value reaches the predetermined threshold, also with respect to the color cartridges, the averaged discharging operation can be performed until the end of the lifetime of the cartridge, so that the lowering in image quality due to the developing roller contamination and the toner deterioration can be prevented.

By performing the above-described operation, the black discharging operation can be performed with the discharging timing of the color cartridges and on the other hand, it is also possible to perform the color discharging operation with the discharging timing of the black cartridge.

As described above, when the processing by the control means 60 is effected, the color discharging operation and the black discharging operation are performed one after another with close timings, so that it is possible to prevent the frequent interruption of the printing. In addition thereto, it is possible to carry out the averaged discharging operation until the end of the lifetime of the cartridge. Therefore, the lowering in image quality due to the developing roller contamination and the toner deterioration can be prevented.

In this embodiment, the single-color mode in which only one-color image is printed is described as the black mode in which only the black image is printed but the single-color mode is not limited to the black mode but may also be those of other colors such as cyan only.

In this embodiment, the monochromatic discharge value and the full-color discharge value are calculated from the total monochromatic print number (total number of monochromatic image formation), the total full-color print number (total number of full-color image formation), and the total number of occurrences of the discharging operation.

Embodiment 2

In this embodiment, referring to FIG. 1, a control means 60 takes charge of control of the entire image forming apparatus. The control means 60 at least includes a CPU 61, a black counter 62 for calculating black discharging and a color counter 63 for calculating cyan discharging with respect to yellow, magenta and cyan. The black counter 62 counts the monochromatic discharge value (first value). The color counter 63 counts the full-color discharge value (second value)

(Discharging Operation)

Next, an operation during the discharging will be described. The discharging operation refers to an operation for refreshing the toner in the neighborhood of the developing roller 41 by transferring (discharging) the toner on the developing roller 41 and deteriorated toner in the neighborhood of the developing roller 41 onto the photosensitive drum 1 during non-image formation. More specifically, in this embodiment, the discharging operation refers to a developer discharging operation for discharging the developer in a predetermined amount when the black counter or the color counter reaches a predetermined.

In this embodiment, the case of performing the discharging operation once every printing on 100 sheets of A4-sized transfer material will be described. At this discharging interval, the contamination of the developing roller 41 leading to the lowering in image quality is not caused to occur throughout the continues image formation. The control of the discharging interval may be effected not only by the print number but also by counting the developing roller 41 rotation time or the like.

(Examples and Problems of Discharging Operations Other Than Discharging Operation in the Present Invention)

For example, in the case of the effecting the full-color printing (image formation) (all-color mode), the discharging counter for full-color (calculated by the unshown control means) is counted up by one every one-sheet printing. Then, in the case where the count reaches 100, the printing is temporarily interrupted and then the discharging operation is executed for the time corresponding to one full turn of the developing roller. The discharging counter for full-color is reset to zero. By repeating this operation, the developing roller is refreshed once every 100-sheet printing with reliability to discharge the deteriorated toner, so that developing roller contamination and image defect due to the toner deterioration can be prevented.

However, in the above-described method, the discharging for the black cartridge is delayed by a time period in which the monochromatic printing mode (single-color mode) is executed, so that there is a possibility of occurrences of the developing roller contamination and the toner deterioration.

In view of this possibility, a method of counting the color counter 63 and the black counter 62 separately can be considered.

In this method, when the monochromatic printing is effected the discharging counter for black (calculated by the unshown control means) is counted up by one. Then, in the case where the count for black reaches 100 during the monochromatic printing, the printing is temporarily interrupted and then the discharging operation is executed for the time corresponding to one full turn of the developing roller. The discharging counter for black is reset to zero. As a result, even when the monochromatic printing is continued, the discharging operation for the black cartridge can be performed.

Further, during the color printing, both of the color counter 63 and the black counter 62 are counted up and when the count for color reaches 100, the discharging operation for the color cartridges is executed (all color discharging operation function). On the other hand, when the count for black reaches 100, the discharging operation for the black cartridge is executed (single color discharging operation function).

However, in the case where the full-color printing is continued in a state in which the counts of the color counter 63 and the black counter 62 are deviated from each other, the printing operation is temporarily interrupted and the discharging operation is executed every time when either one of the counts reaches 100. As a result, a waiting time of a user is increased.

In view of this inconvenience, a method in which when the color counter 63 reaches the predetermined threshold at the time of the discharging during the full-color printing, the black discharging operation and the full-color discharging operation are executed in combination can be considered.

In this method, however, the number of occurrences of the black discharging operation is increased, so that the toner is excessively consumed.

(Discharge Operation in this Embodiment)

In this embodiment, a method in which a degree of non-uniformity of the above-described discharge is reduced and the user waiting time is reduced when the toner discharging operation is performed will be described.

Figure 4:
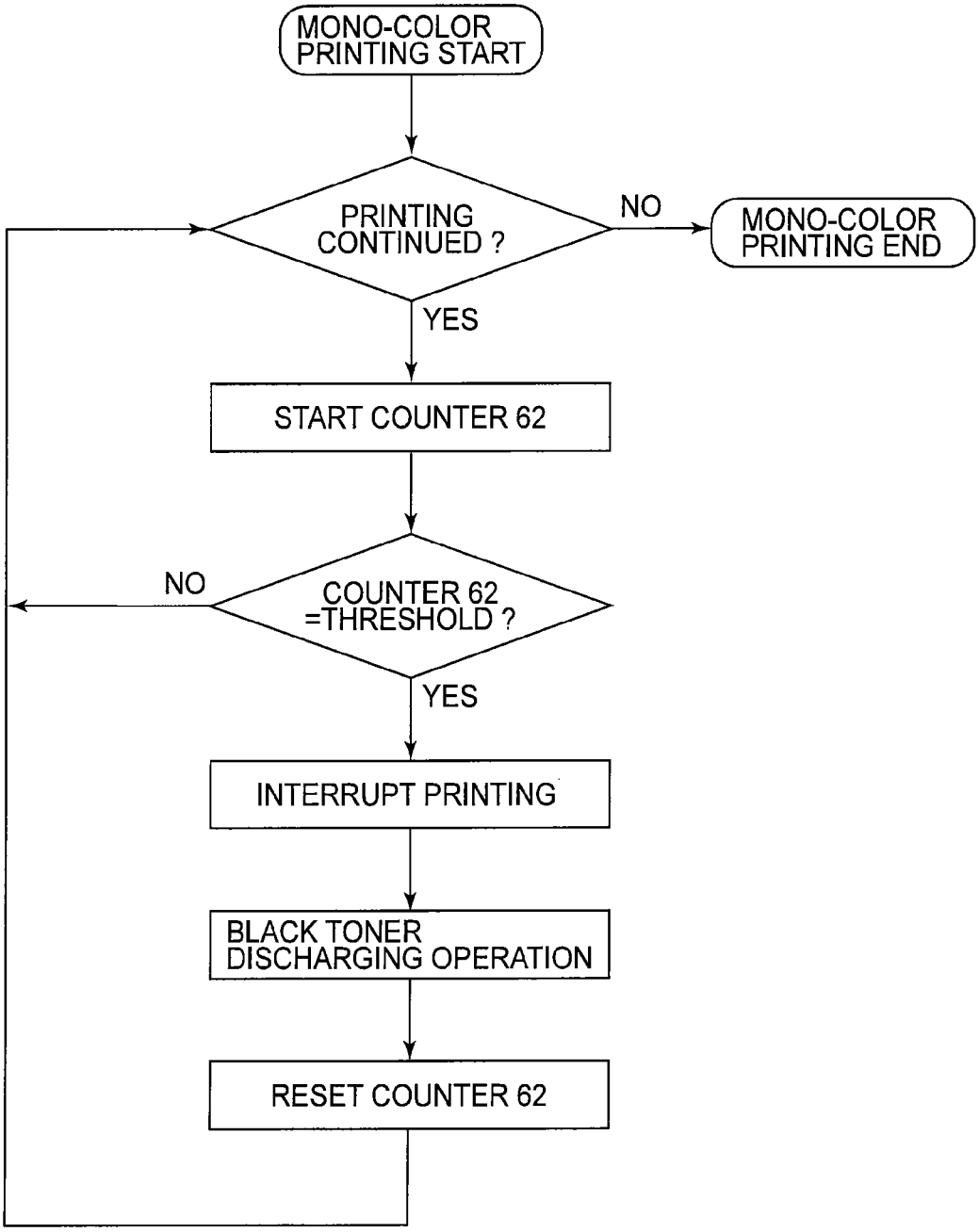
FIG. 4 is a flowchart at the time of monochromatic printing.
Figure 5:
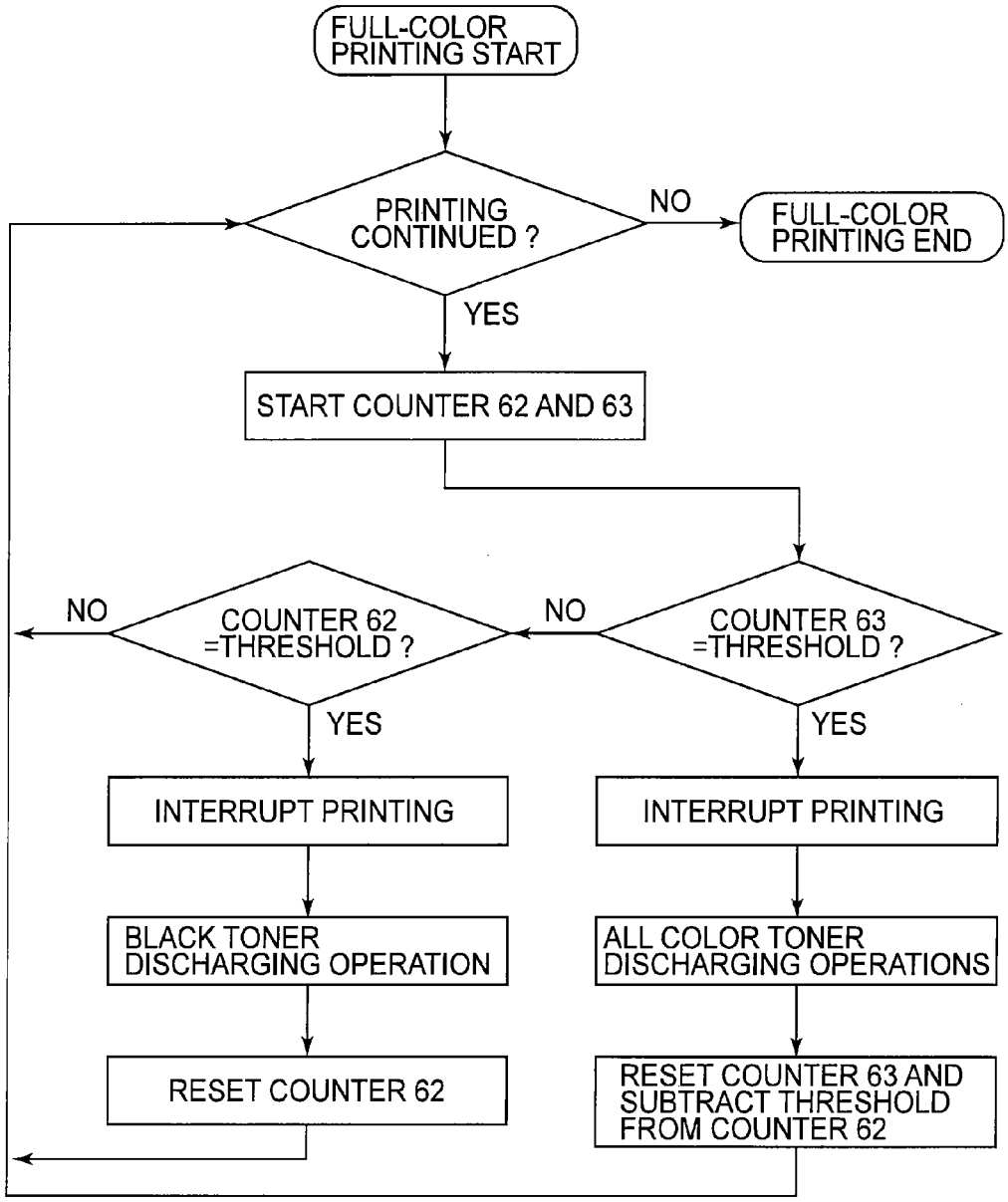
FIG. 5 is a flowchart at the time of full-color printing.

With reference to FIGS. 4 and 5, the discharging operation in this embodiment will be described by using specific numerical values. FIG. 4 is a flowchart at the time of the monochromatic (mono-color) printing and FIG. 5 is a flowchart at the time of the full-color printing.

In this embodiment, both of the counters 62 and 53 are counted up during the full-color printing. Further, during the black printing, only the black counter 62 is counted up.

As shown in FIG. 4, in the case where the black counter 62 reaches 100 during the monochromatic printing, the printing is temporarily interrupted and the black discharging operation is performed. Then, the black counter 62 is reset to zero.

Further, as shown in FIG. 5, in the case where the black counter 62 reaches 100 during the full-color printing, the printing is temporarily interrupted and the black discharging operation is performed. Then, the black counter 62 is reset to zero.

In the case where the color counter 63 reaches 100 during the full-color printing, the printing is temporarily interrupted and the discharging operations for all the colors including black are performed. The color counter 63 is reset to zero and then 100 is subtracted from the black counter 62. At this time, except for the case where the count of the black counter 62 is exactly 100, the count of the black counter 62 is a negative value.

By performing the above-described operation, the black discharging operation can also be performed with discharging timing for the color cartridges, so that frequent interruption of the printing can be prevented.

Further, the number corresponding to the black cartridge discharging operation moved forward by providing the timing of the color cartridge discharging operation to the black cartridge discharging operation is counted as the total number of occurrences of the discharging operation, so that the black counter 62 indicates the negative value. As a result, the timing of the next black cartridge discharging operation is delayed, so that an averaged discharging operation can be performed once every 100-sheet printing until the end of the lifetime of the cartridges.

As a result, it is possible to prevent the lowering in image quality due to the developing roller contamination and the toner deterioration while suppressing the excessive toner consumption.

Incidentally, in the case of using the above method, an interval between the black cartridge discharging operation and its subsequent black cartridge discharging operation can be 199 sheets at the maximum.

The case where the discharging interval of the black cartridge becomes most unstable is the case where the monochromatic printing on one sheet, the full-color printing on 100 sheets, and the monochromatic printing on 199 sheets are repeated from a state in which both of the color counter 63 and the black counter 62 indicate zero. In this case, the black cartridge performs the discharging operation at intervals of 100 sheets, one sheet, and 199 sheets during 300-sheet printing. An average of the discharging is one occurrence per 100 sheets but substantial discharging is once for 200-sheet printing and twice for 100-sheet printing.

Here, in this embodiment, the threshold is 100 but the discharging counter threshold may appropriately set at a value at which the developing roller contamination is not caused to occur even in the case under the above-described condition. Thus, the frequency of the discharging can be kept at the minimum level.

As described above, when the processing by the control means 60 is effected, the color discharging operation and the black discharging operation are performed one after another with close timings, so that it is possible to prevent the frequent interruption of the printing. In addition thereto, it is possible to carry out the averaged discharging operation once every 100-sheet printing until the end of the lifetime of the cartridge. Therefore, the lowering in image quality due to the developing roller contamination and the toner deterioration can be prevented.

In this embodiment, the single-color mode in which only one-color image is printed is described as the black mode in which only the black image is printed but the single-color mode is not limited to the black mode but may also be those of other colors such as cyan only.

The control method in this embodiment will be described with reference to a block diagram of FIG. 6.

Figure 6:
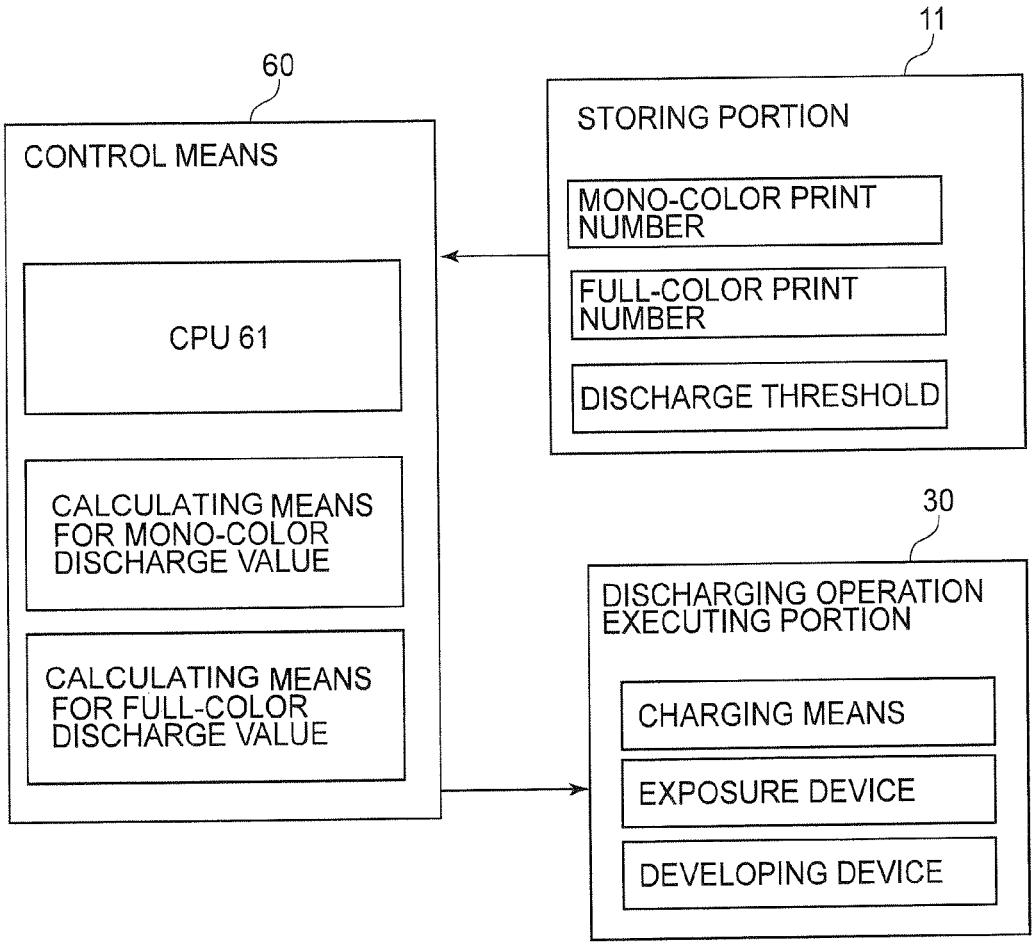
FIG. 6 is a schematic view for illustrating a control method.

In FIG. 6, a storing portion 11 in the image forming apparatus counts the print number in the printing in the monochromatic mode and the print number in the printing in the full-color mode.

Further, in the storing portion 11, information on the discharging threshold is stored in advance.

In FIG. 6, the control means 60 of the image forming apparatus is constituted by the CPU 61, a calculating means for calculating the monochromatic discharge (calculation) value, and a calculating means for calculating the full-color discharge (calculation) value.

In FIG. 6, a discharging operation executing portion 30 includes the charging means, the exposure means, and the developing means in order to perform the discharging operation.

The discharging operation executing portion 30 executes the discharging operation for the time corresponding to one full turn of the developing roller after the printing operation is temporarily interrupted in the case where the monochromatic discharge value and the full-color discharge value reach the predetermined threshold.

Further, in this embodiment, in this embodiment, during the continuous printing, the setting is made so as not to execute the discharging operation in order to minimize downtime and the discharging operation is carried out when the count (value) reaches a range from 100 to 120.

When the count is in the range from 100 to 120, the discharging operation is performed during post-rotation, after execution of remaining toner amount detection, after execution of color misregistration correction detection, or after execution of density detection.

In the case where the count is 120 during the printing, the discharging operation is forcedly carried out.

The reason why the count for performing the discharging operation is set in the range from 100 to 120 is that the count is provided with latitude in order to minimize the downtime during the continuous printing. When the print number is in the range such that the possibility of the lowering in image quality due to the developing roller contamination and the toner deterioration is low, the discharging operation is executed during the post-rotation. In the case where the discharging operation is executed, the lower limit value of 100 in the above-described range is subjected to subtraction.

Incidentally, the threshold for performing the full-color discharging operation and the threshold for performing the monochromatic discharging operation are described as the same value but may also be different values. In this case, when the full-color discharging operation is performed, the threshold for the full-color discharging operation is subtracted from the monochromatic discharger value.

The case where the thresholds for performing the discharging operations in this embodiment are different from each other swill be specifically described by taking as an example the case where the threshold (count) for performing the full-color discharging operation is 100 and the threshold (count) for performing the monochromatic discharging operation is 60.

In this case, both of the counters 62 and 53 are counted up during the full-color printing. Further, during the black printing, only the black counter 62 is counted up.

In the case where the black counter 62 reaches 60 during the monochromatic printing, the printing is temporarily interrupted and the black discharging operation is performed. Then, the black counter 62 is reset to zero.

Further, in the case where the black counter 62 reaches 60 during the full-color printing, the printing is temporarily interrupted and the black discharging operation is performed. Then, the black counter 62 is reset to zero.

In the case where the color counter 63 reaches 100 during the full-color printing, the printing is temporarily interrupted and the discharging operations for all the colors including black are performed. The color counter 63 is reset to zero and then 100 is subtracted from the black counter 62. At this time, except for the case where the count of the black counter 62 is exactly 100, the count of the black counter 62 is a negative value.

By performing such an operation, although the timing of the monochromatic discharging operation cannot be averaged, after the monochromatic discharging is performed at the time of the color discharging, timing of subsequent monochromatic discharging is delayed, so that excessive discharging is not caused to occur.

In the above-described embodiments, the constitution in which the plurality of the photosensitive drums 1 are provided correspondingly to the plurality of the developing rollers 41 is employed but the present invention is not limited thereto. For example, the present invention is applicable to even the case where the image forming apparatus the plurality of the developing rollers 41 is provided correspondingly to a single photosensitive drum 1.

Figure 7:
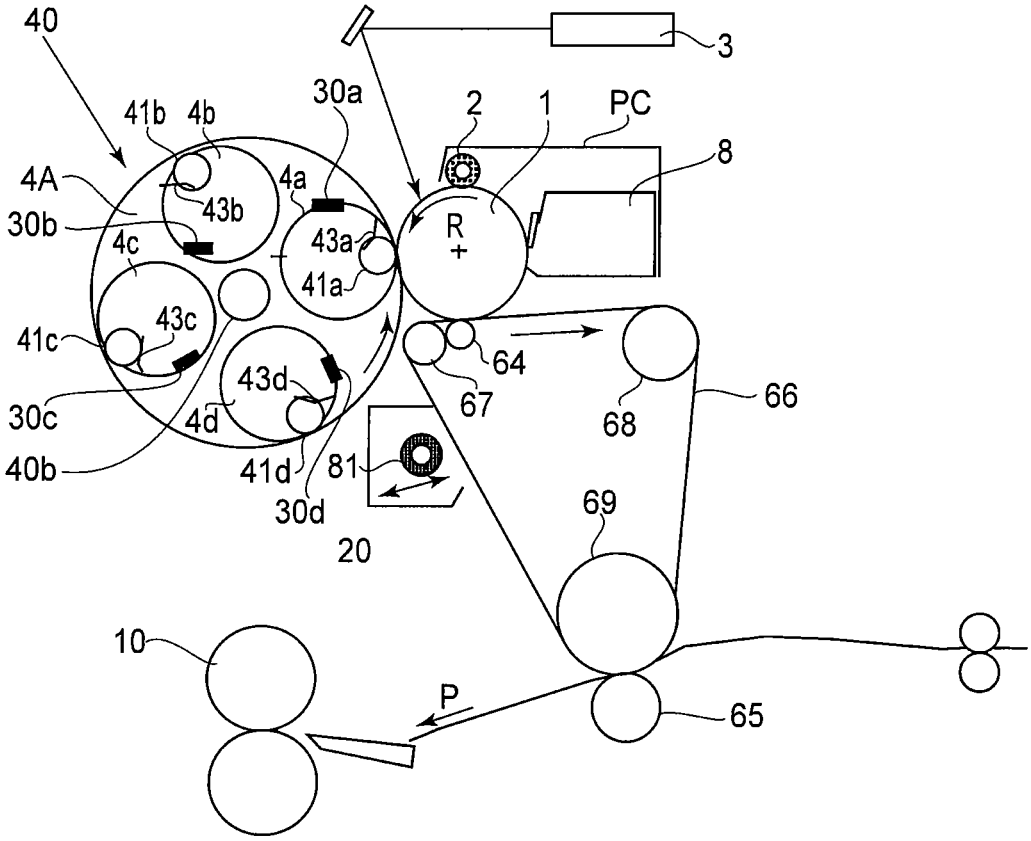
FIG. 7 is a schematic view showing another embodiment of the image forming apparatus.

The case where the present invention is applied to a full-color laser (beam) printer for yellow, magenta, cyan and black as shown in FIG. 7 will be described.

The full-color laser printer in this embodiment, the photosensitive drum 1 is driven in a direction indicated by an arrow R and is electrically charged uniformly to a predetermined potential by the charging roller 2 as the charging means. Then, the photosensitive drum 1 is irradiated with laser light by the exposure device 3 into which a signal in accordance with a yellow image pattern is input, so that an electrostatic latent image is formed on the photosensitive drum 1.

Further, when the photosensitive drum 1 is rotated in the arrow direction, a supporting member 4A is rotated so that, e.g., the developing device 4*a* accommodating yellow toner of four developing devices 4 (4*a*, 4*b*, 4*c* and 4*d*) supported by the supporting member 4A is opposed to the photosensitive drum 1. The latent image is visualized into a toner image by the developing device. The respective developing devices 4*a*, 4*b*, 4*c* and 4*d* have the same structure and function as the developing devices 4 described in Embodiment 1, thus being omitted from redundant description.

The toner image formed on the photosensitive drum 1 is transferred onto an intermediary transfer belt 66 as an intermediary transfer member.

The intermediary transfer belt 66 is stretched around three supporting rollers 67, 68 and 69. The supporting roller 68 connected to an unshown driving source is rotated, so that the intermediary transfer belt 66 is rotated in a direction indicated by an arrow.

Further, inside the intermediary transfer belt 66, a primary transfer roller 64 is provided at a portion where the intermediary transfer belt 66 opposes the photosensitive drum 1. To the primary transfer roller 64, a predetermined bias is applied from a high voltage source (not shown), so that the toner image is transferred from the photosensitive drum 1 onto the intermediary transfer belt 66. Untransferred toner on the photosensitive drum 1 is removed by the cleaning means 8.

The above-described steps are successively performed in the order of magenta, cyan and black with respect to the developing devices 4*b*, 4*c* and 4*d*, respectively, so that four color toner images are formed on the intermediary transfer belt 66 in a superposition matter.

These four color toner images are collectively transferred, by a secondary transfer roller 65, onto the transfer material P conveyed from a sheet-feeding device (not shown) through a conveying means in synchronism with the movement thereof on the intermediary transfer belt 66. Further, the transfer material P is subjected to heating and pressing treatment by the fixing device 7, so that the color toner images are melt-fixed to provide a color image. Untransferred toner on the intermediary transfer belt 66 is removed by a transfer cleaning means 81.

Further, in this embodiment, the photosensitive drum 1, the charging roller 2, and the cleaning means 8 are integrally supported by a frame F to provide a process cartridge PC which is detachably mountable to the main assembly of the image forming apparatus. To the developing devices 4, as shown in FIG. 7, storing means 30 (30*a*, 30*b*, 30*c*, 30*d*) which are a non-volatile memory are provided. The storing means 30*a*, 30*b*, 30*c* and 30*d* function similarly as in Embodiment 1.

Incidentally, also in this embodiment, the respective developing devices 4 (4*a*, 4*b*, 4*c*, 4*d*) for four colors can be demounted in a direction indicated by an arrow C at a mounting and demounting position where the developing device 4*a* shown in FIG. 7 is located and are configured to be detachably mountable to the image forming apparatus main assembly similarly as in the process cartridge PC.

To the above-described developing devices for the respective colors, the methods described in the above embodiments are applicable.

By applying the present invention, the color discharging operation and the black discharging operation are successively performed with close timings, so that frequent interruption of the printing can be prevented.

In this embodiment, there are two types of discharging operation modes. One is mode (first discharging mode) in which a discharging operation (first portion) for only the black cartridge is performed. The other is a mode (second discharging mode) in which a discharging operation (second discharging operation) for the black cartridge is performed simultaneously with the color cartridge discharging operation.

When the second discharging mode is executed, the black counter is decreased to a negative value. For that reason, thereafter, there is a possibility that the number of image formable sheets only in the monochromatic printing mode until the first discharging operation is performed is 100 sheets or more.

On the other hand, in the case where the first discharging operation is performed, the black counter indicates zero. For that reason, thereafter, the number of image formable sheets only in the monochromatic printing mode until the first discharging operation is performed is 100 sheets.

That is, when the present invention is carried out, the number of image formable sheets only in the monochromatic printing mode until the first discharging operation is performed is different between the case of performing the first discharging operation and the case of performing the second discharging operation. Further to say, the number of image formable sheets in the monochromatic printing mode in the case of performing the second discharging operation is larger than that in the case of performing the first discharging operation.

Further, by effecting control in the above embodiment, the number of image formable sheets in the monochromatic printing mode until the subsequent first discharging operation is performed is decreased with an increasing value of the black counter at the time when the second discharging operation is performed. This means that the timing of the first discharging operation is closer with a larger black counter value. For that reason, even when the discharging for the black cartridge is performed in the second discharging mode, the number of image formable sheets in the monochromatic printing mode until the subsequent first discharging operation is decreased.

In the above-described embodiment, the monochromatic (full-color) discharge value is calculated on the basis of the print number (image formation sheet number) in the monochromatic mode and the print number (image formation sheet number) in the full-color mode but the present invention is not limited thereto. The monochromatic (full-color) discharge value may only be required to be information obtainable in association with the amount of usage of the developing roller. For example, the calculation may also be made depending on the rotation time of the developing roller 41. It is also possible to perform the first discharging operation when the rotation time of the developing roller 41 measured as the monochromatic (full-color) discharge value reaches the threshold. The measurement of the developing roller rotation time permits stricter estimation of a deterioration status of the toner in the neighborhood of the developing roller. In the case where the image formation is effected, the developing roller is rotated in some instances as the preparatory operation before the image formation and after the image formation. For this reason, even in the case of the same print number, a total rotation time of the developing roller is different between the case of effecting continuous image formation and the case of effecting intermittent image formation every one sheet.

Incidentally, in the above embodiment, in the case of effecting the full-color discharging, the monochromatic discharge value is subtracted by the discharging threshold of 100 but the present invention is not limited thereto.

The subtraction value is not limited to the discharging threshold so long as the monochromatic discharging value can indicate a negative value.

Further, in the embodiments described, above, the print number or the like is counted up but, on the contrary, may also be counted down. For example, the threshold is taken as −100 and the print number is counted down. When the print number reaches −100, the discharging operation is performed and then −100 as the threshold is added to the count (value) to reset the count to zero. This method can also be employed.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 019594/2009 filed Jan. 30, 2009, which is hereby incorporated by reference.

What is claimed is:

1. An image forming apparatus comprising:

a first developer carrying member for carrying a developer for visualizing an electrostatic latent image formed on a first image bearing member;

a second developer carrying member for carrying a developer for visualizing an electrostatic latent image formed on a second image bearing member; and a control device for controlling a discharging operation for discharging the developer from at least one of said first developer carrying member and said second developer carrying member to at least an associated one of the first image bearing member and the second image bearing member, wherein said image forming apparatus is operable in a first mode in which an image of a single color is formed by using said first developer carrying member and is operable in a second mode in which an image of a plurality of colors is formed by using said first developer carrying member and said second developer carrying member, wherein said control device controls a first discharging operation for discharging a predetermined amount of the developer from said first developer carrying member to the first image bearing member and controls a second discharging operation for discharging a predetermined amount of the developer from each of said first developer carrying member and said second developer carrying member to an associated one of the first and second image bearing members, and wherein said control device is capable of controlling an executable number of image formations effected only in the first mode so that the executable number in a period from completion of the second discharging operation to start of the first discharging operation is larger than the executable number in a period from completion of the first discharging operation to start of a subsequent first discharging operation.

2. An apparatus according to claim 1, wherein said control device calculates a first value to be obtained in interrelation with an amount of usage of said first developer carrying member and a second value to be obtained in interrelation with an amount of usage of said second developer carrying member, wherein said control device controls the first discharging operation for discharging the predetermined amount of the developer from said first developer carrying member to the first image bearing member when the first value reaches a first threshold and controls the second discharging operation for discharging the predetermined amount of the developer from each of said first developer carrying member and said second developer carrying member to the associated one of the first and second image bearing members when the second value reaches a second threshold, and wherein said control device is capable of increasing the executable number of image formations in the period from completion of the second discharging operation to start of the first discharging operation, by decreasing the first value when the second discharging operation is executed, when the image formation is executed only in the first mode without being executed in the second mode.

3. An apparatus according to claim 2, wherein said control device adds the second threshold to or subtracts the second threshold from the first value and the second value when the second discharging operation is executed.

4. An apparatus according to claim 2 or 3, wherein the first value and the second value are obtained from a total number of image formations in the first mode, a total number of image formations in the second mode, a number of the first discharging operation, and a number of the second discharging operation.

5. An apparatus according to claim 2 or 3, wherein the first value and the second value are obtained on the basis of a rotation time of said first developer carrying member and a rotation time of said second developer carrying member.

6. An apparatus according to claim 2 or 3, wherein the first value and the second value are obtained on the basis of the number of image formations in the first mode and the number of image formations in the second mode.

7. An apparatus according to claim 1, further comprising:

a belt onto which a developer image formed on the first image bearing member and a developer image formed on the second image bearing member are to be transferred;

a transferring device movable toward and away from the first image bearing member or the second image bearing member through said belt; and a contact and separation mechanism for urging said transferring device against the first developer image bearing and the second image bearing member in the second mode and for moving said transferring device away from the second image bearing member in the first mode.

8. An image forming apparatus comprising:

a first developer carrying member for carrying a developer for visualizing an electrostatic latent image formed on an image bearing member;

a second developer carrying member for carrying a developer for visualizing an electrostatic latent image formed on the image bearing member; and a control device for controlling a discharging operation for discharging the developer from at least one of said first developer carrying member and said second developer carrying member to the image bearing member, wherein said image forming apparatus is operable in a first mode in which an image of a single color is formed by using said first developer carrying member and is operable in a second mode in which an image of a plurality of colors is formed by using said first developer carrying member and said second developer carrying member, wherein said control device controls a first discharging operation for discharging a predetermined amount of the developer from said first developer carrying member to the image bearing member and controls a second discharging operation for discharging a predetermined amount of the developer from each of said first developer carrying member and said second developer carrying member to the image bearing member, and wherein said control device is capable of controlling an executable number of image formations effected only in the first mode so that the executable number in a period from completion of the second discharging operation to start of the first discharging operation is larger than the executable number in a period from completion of the first discharging operation to start of a subsequent first discharging operation.

9. An apparatus according to claim 8, wherein said control device calculates a first value to be obtained in interrelation with an amount of usage of said first developer carrying member and a second value to be obtained in interrelation with an amount of usage of said second developer carrying member, wherein said control device controls the first discharging operation for discharging the predetermined amount of the developer from said first developer carrying member to the first image bearing member when the first value reaches a first threshold and controls the second discharging operation for discharging the predetermined amount of the developer from each of said first developer carrying member and said second developer carrying member to the image bearing member when the second value reaches a second threshold, and wherein said control device is capable of increasing the executable number of image formations in the period from completion of the second discharging operation to start of the first discharging operation, by decreasing the first value when the second discharging operation is executed, when the image formation is executed only in the first mode without being executed in the second mode.

10. An apparatus according to claim 8, wherein said control device adds the second threshold to or subtracts the second threshold from the first value and the second value when the second discharging operation is executed.

11. An apparatus according to claim 9 or 10, wherein the first value and the second value are obtained from a total number of image formations in the first mode, a total number of image formations in the second mode, a number of the first discharging operation, and a number of the second discharging operation.

12. An apparatus according to claim 9 or 10, wherein the first value and the second value are obtained on the basis of a rotation time of said first developer carrying member and a rotation time of said second developer carrying member.

13. An apparatus according to claim 9 or 10, wherein the first value and the second value are obtained on the basis of the number of image formations in the first mode and the number of image formations in the second mode.

* * * * *